US010677458B2

(12) United States Patent
Agrawal

(10) Patent No.: US 10,677,458 B2
(45) Date of Patent: Jun. 9, 2020

(54) COMBUSTOR ASSEMBLY FOR LOW-EMISSIONS AND ALTERNATE LIQUID FUELS

(71) Applicant: The Board of Trustees of The University of Alabama, Tuscaloosa, AL (US)

(72) Inventor: Ajay K. Agrawal, Tuscaloosa, AL (US)

(73) Assignee: The Board of Trustees of The University of Alabama, Tuscaloosa, AL (US)

( * ) Notice: Subject to any disclaimer, the term of this patent is extended or adjusted under 35 U.S.C. 154(b) by 290 days.

(21) Appl. No.: 15/484,197

(22) Filed: Apr. 11, 2017

(65) Prior Publication Data

US 2017/0292696 A1 Oct. 12, 2017

Related U.S. Application Data

(60) Provisional application No. 62/321,288, filed on Apr. 12, 2016.

(51) Int. Cl.
*F23D 11/10* (2006.01)
*F23D 11/14* (2006.01)
(Continued)

(52) U.S. Cl.
CPC ..... *F23D 11/107* (2013.01); *F23C 7/004* (2013.01); *F23D 11/101* (2013.01); *F23D 11/14* (2013.01);
(Continued)

(58) Field of Classification Search
CPC ..... F23C 7/004; F23D 11/101; F23D 11/107; F23D 11/14; F23D 11/38; F23D 11/383; F23D 17/002
(Continued)

(56) References Cited

U.S. PATENT DOCUMENTS 6,151,887 A * 11/2000 Haidn ..... F02K 9/64 60/257
7,611,563 B2 * 11/2009 Memoli ..... C21C 5/5217 266/221
2007/0113465 A1 5/2007 Pech

OTHER PUBLICATIONS

#2 diesel MSDS, retrieved on line from http://www.petrocard.com/Products/MSDS-ULS.pdf, dated Dec. 1, 2016, 8 pages.
(Continued)

*Primary Examiner* — Steven B McAllister
*Assistant Examiner* — Benjamin W Johnson
(74) *Attorney, Agent, or Firm* — Meunier Carlin & Curfman LLC

(57) ABSTRACT

Implementations of a combustor assembly yield low emissions, require low power, are suitable for alternate liquid fuels, including highly viscous fuels, and are scalable for various heat release rates. The combustor assembly includes a fuel injector and a swirler. The fuel injector may include a choke portion and a spacer. The choke portion is disposed just upstream of an outlet of a liquid fuel conduit and prevents atomizing gas from interrupting continuous flow of the liquid fuel through the liquid fuel conduit. The spacer is disposed downstream of the outlet to precisely control the gap and thus, bifurcation of atomizing gas flow, between the outlet of liquid fuel conduit and an inlet of an orifice plate. The swirler is disposed radially outwardly and adjacent the fuel injector and includes a plurality of angled vanes.

18 Claims, 3 Drawing Sheets

(51) Int. Cl.
*F23D 11/38* (2006.01)
*F23D 17/00* (2006.01)
*F23C 7/00* (2006.01)

(52) U.S. Cl.
CPC ..... *F23D 11/38* (2013.01); *F23D 11/383* (2013.01); *F23D 17/002* (2013.01)

(58) Field of Classification Search
USPC ..... 431/183
See application file for complete search history.

(56) References Cited

OTHER PUBLICATIONS

Birouk, et al., "Role of viscosity on trajectory of liquid jets in a cross-airflow", Atomization and Sprays, vol. 17, 2007, pp. 267-287.
Bohon, et al., "Glycerol combustion and emissions", Proceedings of the Combustion Institute, 33:2, Sep. 23, 2010, pp. 2717-2724.
Ferreira, et al., Detailed Investigation of the Influence of Fluid Viscosity on the Performance Characteristics of Plain-Origice Effervescent Atomizers, Atomization and Sprays 11, 2001, pp. 107-124.
Gañán-Calvo, "Enhanced liquid atomization: From flow-focusing to flow-blurring" Applied Physics Letters, vol. 86, No. 21, 2005, pp. 2141-2142.
Glycerol MSDS, retrieved from http://www.jtbaker.com/Msds/englishhtml/g4774.htm, created Oct. 10, 2005, last updated May 21, 2013, 6 pages.
Huang, "Flame colour characterization in the visible and infrared spectrum using a digital camera and image processing", Meas. Sci. Technol. 19 (2008) 085406, 9 pages.
Agrawal, Inventor's DOE project summary describes using flow-blurring injector to combust glycerine: Low-Emissions Burner Technology using Biomass-Derived Liquid Fuels, http://www1.eere.energy.gov/industry/fuelflexibility/pdfs/fuel-flex_burner.pdf , Sep. 2009.
Lefebvre, "Twin-fluid atomization: Factors influencing mean drop size", Atomization and Sprays 2, 1992, 101-119.
Lefebvre, "Airblast atomization", Prog. Energy Combust. Sci. 6 1980, 233-261.
Llompart, et al., "Turbulence in pneumatic flow focusing and flow blurring regimes", Physical Review E 77, 2008, 036321.
Mansour, "Gas Turbine Fuel Injection Technology," American Society of Mechanical Engineering Paper GT-2005-68173, 2005, pp. 141-149.
McDonell, et al., "Gas and Drop Behavior in Reacting and Non-Reacting Airblast Atomizer Sprays," J. Propulsion, vol. 7, No. 5, 1991, pp. 684-691.
Metzger, Glycerol Combustion, M.S. Thesis, North Carolina State University, Aug. 1, 2007, 53 pages.
Nakamura, et al., "The Effect of Liquidfuel Preparation on Gas Turbine Emissions," American Society of Mechanical Engineering Paper GT-2006-90730, 2006.
Panchasara et al., "Combustion Performance of Biodiesel and Diesel-Vegetable Oil Blends in a Simulated Gas Turbine Burner", J. Eng. Gas Turbines Power 131 (2009) 031503: 1-11.
Panchasara, et al., "Emissions Reductions in Diesel and Kerosene Flames Using a Novel Fuel Injector", J. Propul. Power 25 (2009) 984-987.
Panchasara, et al., Effect of Fuel Preheating on Emissions from Combustion of Viscous Biofuels, 6$^{th}$ US Combustion Meeting, 2007, San Diego, CA, Paper G-12-Spray.
Razdan, et al., "Fuel/Air Preparation in the Design of Low Emissions Gas Turbine Combustion Systems," Fourteenth NATO RTO Meeting on Gas Turbine Combustion Emissions and Alternative Fuels, NATO Paper 34, 1998.
Sadasivuni and Agrawal, "A novel meso-scale combustion system for operation with liquid fuels", Proceedings of the Combustion Institute 32 (2009) 3155-3162.
Sahin and Durgum, "Theoretical investigation of effects of light fuel fumigation on diesel engine performance and emissions", Energy Convers. Manage. 48 (2007) 1952-1964.
Sharma, et al., "Soybean Oil-Based Lubricants: A Search for Synergistic Antioxidants", Energy & Fuels, 2007, vol. 21, No. 4, pp. 2408-2414.
Sheng, et al., "Viscosity, surface tension, and atomization of water-methanol and diesel emulsions", Atomization and Sprays 16 (2006), pp. 1-13.
Simmons, et al., Flow and Dropsize Measurements in Glycerol Spray Flames, 50th AIAA Aerospace Sciences Meeting, Nashville, Tennessee, AIAA 2012-0523, Jan. 9-12, 2012.
Simmons, et al., Spray Characteristics of a Flow-Burring Atomizer, Atomization and Sprays, vol. 20, No. 9, 2010, pp. 821-825.
Simmons, et al., Drop Size and Velocity Measurements in Bio-Oil Sprays Produced by the Flow-Blurring Injector, GT2011-46832, Proceedings of ASME Turbo Expo, Jun. 6-10, 2011, Vancouver, CAN, 10 pages.
Simmons, et al., Glycerol Combustion using Flow-Burring Atomization, The 2010 Technical Meeting of the Central States Section of the Combustion Institute, Champaign, Illinois, 2010, pp. 1-7.
Simmons, et al., A Comparison of Air-Blast and Flow-Burring Injectors Using Phase Doppler Particle Analyzer Technique, A.K. Proceedings of ASME Turbo Expo 2009: Power for Land, Sea and Air, Jun. 8-12, 2009, GT2009-60239.
Simmons, et al., Effect of Fuel Injection Concept on Combustion Performance of Liquid Biofuels, Proceedings of the 2008 Technical Meeting of the Central Sates Section of the Combustion Institute, The Combustion Institute, 2008.
Sovani, et al., "Effervescent Atomization," Progress in Energy and Combustion Science, vol. 27, No. 4, 2001, pp. 483-521.
Terigar, et al., "Transesterification of Soybean and Rice Bran Oil with Ethanol in a Continuous-Flow Microwave-Assisted System: Yields, Quality, and Reaction Kinetics", Energy & Fuels, 2010, vol. 24, pp. 6609-6615.

* cited by examiner

COMBUSTOR ASSEMBLY FOR LOW-EMISSIONS AND ALTERNATE LIQUID FUELS

CROSS-REFERENCE TO RELATED APPLICATIONS

This application claims priority to U.S. Provisional Patent Application No. 62/321,288, filed Apr. 12, 2016, and entitled "COMBUSTOR ASSEMBLY FOR LOW-EMISSIONS AND ALTERNATE LIQUID FUELS," the entire disclosure of which is incorporated herein by reference.

STATEMENT REGARDING FEDERALLY SPONSORED RESEARCH OR DEVELOPMENT

This invention was made with government support under grant no. DE-EE0001733 awarded by the Department of Energy. The government has certain rights in the invention.

BACKGROUND OF THE INVENTION

Fluctuating fuel prices, unabated energy sustainability concerns, and waste energy byproducts generated in industry have created the opportunity to develop fuel flexible combustion systems. A combustion system's capability to handle multiple liquid fuels depends on the fuel injector. Most combustion applications have limited fuel flexibility mainly because of the strong dependence of the injector performance on physical and chemical properties of the fuel. Thus, an ideal fuel injector would perform robustly with minimal dependence on fuel properties. The most common fuel injection techniques are: pressure driven as in direct injection systems, and kinetic energy driven as in twin-fluid atomizers. Less commonly used techniques include centrifugal energy driven atomization as in rotating discs, and effervescent, flashing, electrostatic, vibratory, and ultrasonic atomizers.

Twin-fluid injectors utilize kinetic energy provided by a gas introduced in the injector system, mainly for the purpose of enhancing atomization of the liquid fuel. An air-blast (AB) injector is a typical example of a twin fluid atomizer. In AB atomization, atomizing air and liquid are supplied separately to the injector. Air is delivered and swirled on the outer periphery of the injected liquid fuel at a relatively large velocity to break up the ejected fuel and to disperse the resulting spray in the combustion zone. The primary driving force of liquid break up and droplet formation is by the shear forces formed because of the high relative velocities between the two phases. However, a major shortcoming of this technique is that in highly viscous liquids such as glycerol or straight vegetable oils, or other alternative and opportunity fuels, shear layer instabilities are suppressed, giving rise to less effective droplet break up or larger droplet diameters in the spray.

Another twin fluid injector is an effervescent atomizer (EA). In EA, a pressurized gas is injected into the bulk liquid fuel inside an atomizer body, upstream of a nozzle orifice from which the fuel-air mixture is ejected into the combustion zone. Bubbles formed by the injected gas are then expanded rapidly when the two-phase mixture is exposed to a low pressure zone at the orifice exit, breaking up the liquid into droplets. EA is reported to produce a spray with very fine droplets. However, this method has known drawbacks in that the spray angle is usually narrow and atomizing air must be pressurized to the fuel supply pressure. This pressurization can be difficult to accomplish and might require large amounts of power. In addition, the spray produced can exhibit undesirable unsteadiness related to two-phase mixing flow processes in the channel downstream of the mixing chamber.

Accordingly, an improved fuel-flexible combustion system is needed that yields low emissions, requires low power, is suitable for alternate liquid fuels including highly viscous processed or unprocessed fuels, and can be scaled to different heat release rates.

BRIEF SUMMARY

Various implementations include a fuel injector that includes an inner injector tube, an outer injector tube, a spacer ring, and an orifice plate. The inner injector tube includes an outlet portion defining an outlet and a choke portion. The choke portion is disposed below the outlet 10 D to 20 D, wherein D is the inner tube diameter. The outer injector tube is spaced radially apart from at least the outlet portion of the inner injector tube. The outer injector tube has an outer injector tube outlet disposed radially adjacent the outlet of the inner injector tube. The spacer ring includes an annular wall that defines a central axial opening and has an upper annular surface. The orifice plate defines a central opening that has an inlet side and an outlet side. The central opening defines a frustoconical cross-sectional shape as taken along a central axis extending through the central opening. An inner diameter of the inlet side is smaller than an inner diameter of the outlet side, and the inner diameter of the inlet side is substantially the same as an inner diameter of the outlet of the inner injector tube. And, the central opening of the orifice plate is co-axial with and spaced above the outlet of the inner injector tube.

In some implementations, the choke portion is a venturi constriction portion having an inner diameter that is smaller than the inner diameter of the outlet of the inner injector tube. In some implementations, the choke portion is a check valve.

In some implementations, the choke portion is integrally formed in the inner injector tub, and in other implementations, the choke portion is formed separately from the inner injector tube and disposed therein.

In some implementations, the choke portion is disposed 10 D to 20 D below an outlet of the inner injector tube.

In some implementations, the choke portion has an inner diameter of between 0.2 D and 0.4 D.

In some implementations, the upper annular surface of the spacer ring defines a plurality of axial slots, and the spacer ring is disposed adjacent the outlet of the inner injector tube, the outer injector tube outlet, and the inlet of the orifice plate such that the central opening of the orifice plate and the outlet of the inner injector tube are co-axial with the central axial opening of the spacer ring. In a further implementation, the annular wall further defines a plurality of radially extending openings, and the radially extending openings are defined circumferentially between the axial slots and are spaced apart circumferentially around the annular wall. In some implementations, each axial slot has a height that is at least 0.2 D and a width that is twice the height of the slot, wherein the width is measured in a direction that is tangent to a circumference of the annular wall.

Various other implementations include a combustor assembly that includes a fuel injector, such as described above, and a swirler. The swirler is disposed radially outwardly and adjacent the outer injector tube outlet. The swirler includes a central hub, a first plurality of vanes extending therefrom a first angle greater than 0 degrees from a plane extending perpendicular to a central axis of the central hub, and a second plurality of vanes disposed radially outwardly of the first plurality of vanes and at a second angle greater than 0 degrees from the plane, wherein the swirler is in fluid communication with a gas supply plenum adjacent an inlet side of the swirler and a combustion housing adjacent an outlet side of the swirler.

In some implementations, the choke portion is disposed 10 D below the outlet of the inner injector tube.

In some implementations, the first and second plurality of vanes are disposed at an angle of 30 degrees relative to the plane.

BRIEF DESCRIPTION OF THE DRAWINGS

The components in the drawings are not necessarily to scale relative to each other and like reference numerals designate corresponding parts throughout the several views.

DETAILED DESCRIPTION

According to various implementations, a combustor assembly is described that yields low emissions, requires low pumping power, is suitable for conventional and alternate liquid fuels, including highly viscous processed or unprocessed fuels, and can be scaled to different heat release rates. The combustor assembly according to certain implementations includes a FB injector.

Figure 1:
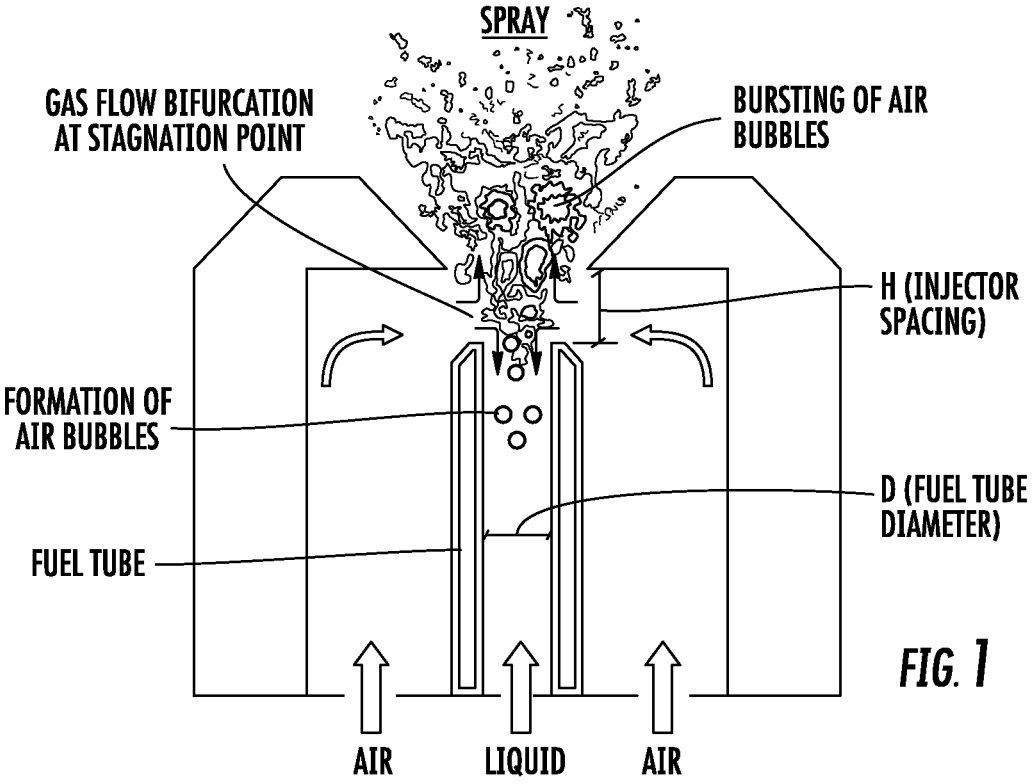
FIG. 1 shows a schematic illustration of flow blurring (FB) atomization's working principle.

A twin-fluid atomization technique known as Flow Blurring (FB) atomization was recently proposed by A. M. Gañán-Calvo. This technique is reported to produce finer droplets with up to fifty times the surface area to volume ratio and atomization efficiency of tenfold when compared to AB atomization. FIG. 1 shows a schematic illustration of FB atomization's working principle. Atomizing gas is forced through a small gap between an exit of the liquid tube and a coaxial orifice located at distance "H" downstream of the exit of the liquid tube. For H/D of 0.25 or less (wherein D is the orifice diameter), the atomizing gas flow turns radially as it enters the gap H and a stagnation point develops somewhere between the exit of liquid tube and the orifice. Thus, the atomizing gas flow is bifurcated about the stagnation point, with part of the gas being directed upstream into the liquid tube and the rest flowing out through the orifice. The back flow gas that enters the liquid tube results in turbulent two-phase mixing with the incoming liquid, which is characterized by "turbulent inertial cascade mechanics." By introducing the atomizing gas downstream of the liquid tube exit, the atomization process requires less energy.

The injector, according to various implementations, uses the FB atomization technique shown in FIG. 1 and further includes a choke, or reduced diameter, portion in an inner injector tube, or liquid fuel conduit. The choke is disposed just upstream of the outlet of the inner injector tube. For example, the choke portion may be disposed within a distance of 10 D to 20 D of the outlet. The choke portion may include a valve or a venturi constriction portion having an inner diameter that is less than the inner diameter of the outlet of the inner injector tube. A high pressure area is formed downstream of the choke portion, which prevents the atomizing air from flowing past the choke portion and preventing the liquid fuel from flowing continuously through the inner injector tube, in particular during changes in the fuel or air flow rates.

In some implementations, the space between the outlet of the inner injector tube and the orifice plate is precisely controlled by a spacer.

In addition, in some implementations, the combustor assembly also includes a swirler disposed radially adjacent an exit plane of the FB injector. The swirler may be a single, double, or multi-vane swirler. The swirler may include a plurality of angled vanes that cause gas, such as air, a combustible gas or a mixture of gases, to swirl upon exiting the swirler. The swirled gas assists with breaking up any remaining fuel streaks that exit the orifice plate, and assist in pre-vaporizing the fuel, which results in low emissions. Smaller applications may include a single vane swirler and larger applications may include a double swirler, according to some implementations.

Furthermore, according to various implementations, the combustor assembly may be used in small or large heat release rate environments. The combustor assembly is a dual fuel burner and as such it may use gaseous fuels and liquid fuels separately or both gaseous and liquid fuels at the same time. In addition, the dual fuel combustor assembly may have a smaller capacity, such as between 5 kWth and 10 kWth capacity (e.g., 7 kWth capacity) or a larger capacity, such as between 60 kWth and a 100 kWth capacity.

Figure 2:
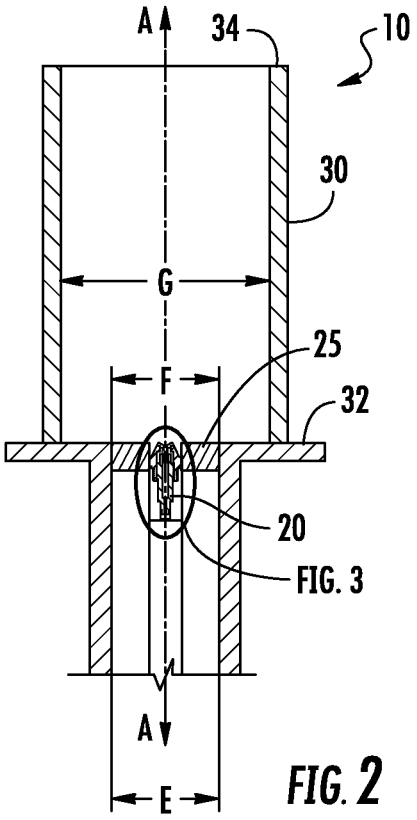
FIG. 2 illustrates a cross-sectional view of the burner according to various implementations.

FIG. 2 illustrates an exemplary environment in which the combustor assembly according to various implementations may be used. The combustor assembly includes an improved FB fuel injector 20 and a swirler 25. The combustion environment shown in FIG. 2 is a burner assembly 10. FB fuel injector 20 is disposed along a central axis A-A of the burner assembly 10. The swirler 25 is disposed circumferentially around and adjacent to the FB fuel injector 20. The burner assembly 10 also includes a combustion chamber 30 having an inlet side that is coplanar with a dump plane 32 and an outlet side 34. An exit of the FB fuel injector 20 and the swirler 25 are also co-planar with the dump plane 32. However in other implementations, the exit of the FB fuel injector 20 and/or the swirler 25 may not be co-planar with the dump plane 32.

Figure 3:
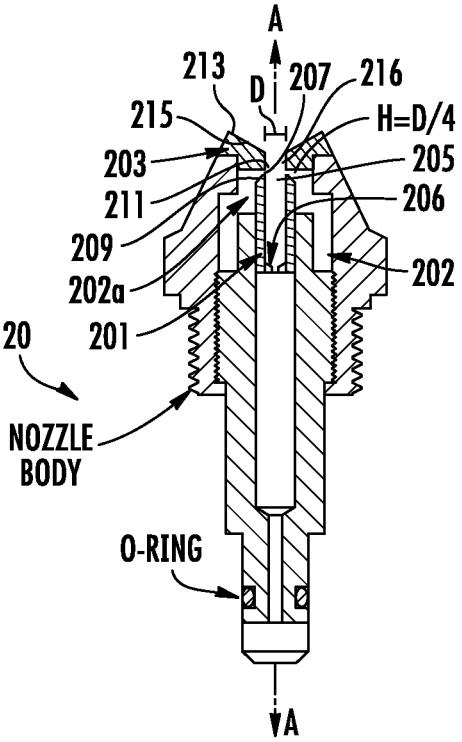
FIG. 3 illustrates a cross-sectional view taken along the A-A line of a FB injector according to one implementation.

FIG. 3 illustrates a cross section of the FB fuel injector 20 taken along the A-A axis. The FB injector 20 includes an inner injector tube 201, an outer injector tube 202, and an orifice plate 203. The inner injector tube 201 defines an outlet 205 and includes a choke portion 206 that is disposed axially below the outlet 205 between 10 D to 20 D. For example, the choke portion 206 may be disposed axially below the outlet 205 1 cm for D=1 mm. In addition, an outer diameter of a portion 209 of the inner injector tube 201 adjacent the outlet 205 may taper radially inwardly and axially toward the outlet 205.

The orifice plate 203 defines a central opening having an inlet side 211 and an outlet side 213 along the axis A-A. The central opening includes a portion 215 defining a frustoconical-shaped opening and a portion 216 defining a cylindrical-shaped opening. The frustoconical portion 215 extends between an outlet side 213 of the plate 203 and the cylindrical portion 216 such that an inner diameter of the frustoconical portion 215 decreases along the axis A-A from the outlet side 213 to the cylindrical portion 216, and the cylindrical portion 216 extends between an inlet side 211 of the plate 203 to the frustoconical portion 215. An inner diameter of cylindrical portion 216 is smaller than the inner diameter at the outlet side 213 of the central opening and is substantially the same as the inner diameter D of the outlet 205 of the inner injector tube 201. The inlet side 211 of the orifice plate 203 is spaced axially above the outlet 205 of the inner injector tube 201 by a distance H, which is a quarter of the diameter D of the outlet 205 of the inner injector tube 201. The outlet side 213 of the central opening is within the dump plane 32 of the assembly 10.

The outer injector tube 202 is spaced apart radially outwardly from the inner injector tube 201 and defines a space 202*a* between an inner wall of the outer injector tube 202 and the outer wall of the inner injector tube 201 through which pressurized gas flows. The outer injector tube 202 includes an outlet portion 207 adjacent the outlet 205 of the inner injector tube 201. In particular, the outlet portion 207 is defined by the usually tapered portion 209 of the inner injector tube 201 and a portion of the orifice plate 203 that is adjacent the inlet side 211 of the central opening.

Pressurized liquid fuel flows through a liquid fuel inlet into the inner injector tube 201. In addition, pressurized gas flows through an atomizing gas inlet into the space 202*a*. This pressurized gas is forced through the outlet 207 and between the outlet 205 of the inner injector tube 201 and the inlet side 211 of the central opening of the orifice plate 203. The pressurized gas turns radially as it enters this space, and a stagnation point develops somewhere between the outlet 205 of the inner injector tube 201 and the inlet side 211 of the orifice plate 203. Thus, the pressurized, or atomizing, gas flow is bifurcated about the stagnation point, with part of the gas being directed upstream into the inner injector tube 201 and the rest flowing out through the orifice plate 203. The back flow gas that enters the inner injector tube 201 results in bubbling and turbulent two-phase mixing with the incoming liquid fuel. Exemplary pressurized gases may include air, steam, gaseous fuels such as natural gas or propane, nitrogen, and oxygen.

Figure 4:
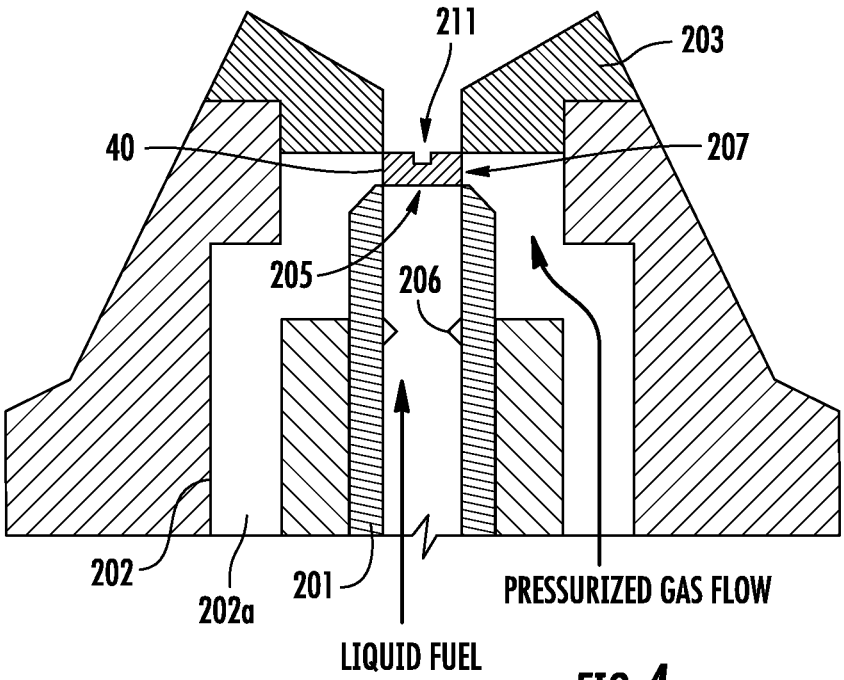
FIG. 4 illustrates a cross-sectional view taken along the A-A line of a FB injector of a spacer disposed downstream of the outlet of an inner injector tube, according to one implementation.
Figure 5:
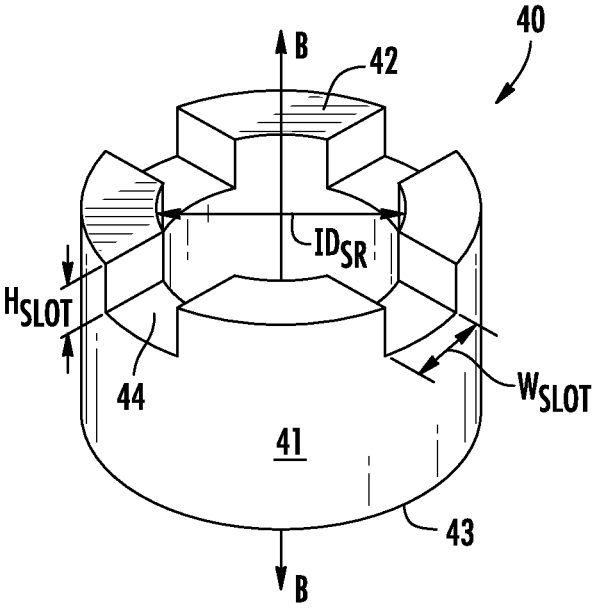
FIG. 5 illustrates a perspective view of the spacer shown in FIG. 4.

A spacer ring with a plurality of slots and/or holes is used to precisely control the geometry, and thus, bifurcation of the atomizing gas, between the outlet 205 of the inner injector tube 201 and the inlet 211 of the orifice plate. For example, as shown in FIG. 4, a spacer ring 40 may be disposed between the outlet 205 of the inner injector tube 201 and the inlet 211 of the orifice 203. FIG. 5 illustrates spacer ring 40 according to one implementation. The spacer ring 40 comprises an annular side wall 41 having an upper surface 42 and a lower surface 43. An inner diameter $ID_{SR}$ of the side wall 41 is substantially equal to the diameter D of the inner injector tube 201. The spacer ring 40 is disposed between the outlet 205 and the inlet 211 such that the central axis A-A of the inner injector tube 201 and a central axis B-B of the spacer ring 40 are co-axial.

The upper surface 42 defines a plurality of slots 44, or axial depressions, that extend axially inwardly from the upper surface 42 and are spaced apart from each other. For example, the implementation shown in FIG. 5 includes four equally spaced slots 44 that are spaced apart from each other around a circumference of the upper surface 42. The axial height $H_{SLOT}$ of each slot 44 is at least one-fifth the inner diameter $ID_{SR}$ of the spacer 40, and the width $W_{SLOT}$ of each slot 44 is twice the height $H_{SLOT}$ of the slot 44. For example, in the implementation shown in FIG. 5, the inner diameter $ID_{SR}$ of the ring 40 is 5 mm, the height $H_{SLOT}$ of each slot 44 is 1 mm, and the width $W_{SLOT}$ of each slot 44 is 2 mm. Furthermore, the height $H_{SR}$ of the spacer ring 40 as measured between the lower surface 43 and the upper surface 42 is about the same as the inner diameter $ID_{SR}$ of the ring 40. The outer diameter $OD_{SR}$ of the ring 40 in this implementation is 8 mm.

Figure 6:
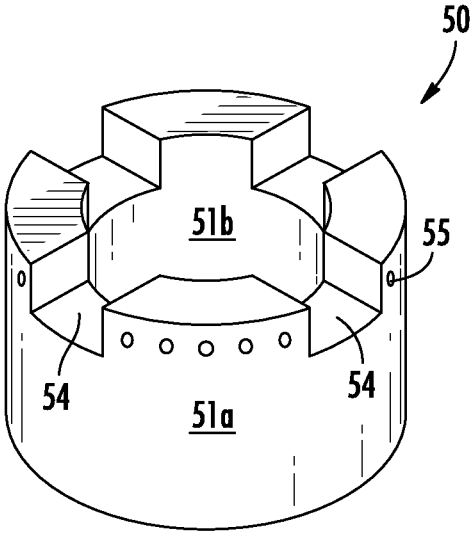
FIG. 6 illustrates a perspective view of a spacer according to another implementation.

FIG. 6 illustrates another implementation of a spacer ring. In particular, spacer ring 50 is similar to spacer ring 40 but further defines a plurality of holes 55 that extend radially between an outer radial surface 51*a* of the annular wall and an inner radial surface 51*b* of the annular wall of the spacer ring 50. The holes 55 are defined between the slots 54 as shown in FIG. 6. The holes 55 may have a diameter of 0.05 D to 0.2 D and are spaced equal distance apart along the outer radial surface 51*a*.

The choke portion 206 creates an area of high pressure just downstream of the choke portion 206 to prevent the pressurized gas from flowing past it and potentially hindering or slowing the flow of the liquid fuel through the inner injection tube 201. In certain implementations, the choke portion 206 may include a venturi constriction portion having a reduced diameter as compared to the inner diameter of the inner injector tube 201 or a valve. In addition, the choke portion 206 may be integrally formed with the inner injector tube 201, such as by pinching the tube 201 radially inwardly at the location for the choke portion 206 or molding or otherwise forming the choke portion 206 within the inner injector tube 201. Alternatively, the choke portion 206 may be formed separately and inserted into the inner injector tube 201. In one implementation where choke point is located 10 D to 20 D upstream of the outlet 205 of the inner injector tube 201, the diameter at the choked point can be 0.2 D to 0.4 D, the upstream converging length can be 2 D, and the downstream diverging length can be 4 D, where D is the diameter of the inner injector tube 201.

Figure 7:
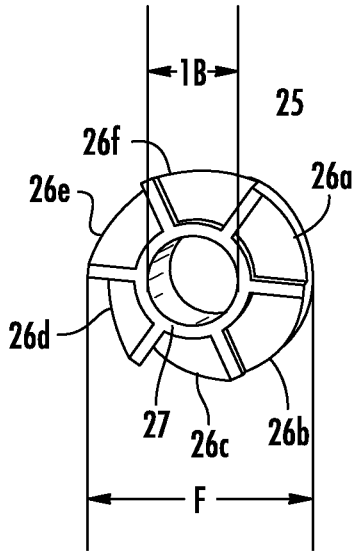
FIG. 7 illustrates a top view of an inlet swirler used for the burner shown in FIG. 2 according to one implementation.

The swirler 25 is disposed circumferentially around and adjacent to the FB fuel injector 20 and swirls a primary gas and/or a gaseous fuel mixture into the combustion housing 30. In particular, as shown in FIG. 7, the swirler 25 is a static structure that includes a central hub 27 having a central axis that is coaxial with axis A-A. A plurality of vanes 26*a*-26*f* extend from the hub 27 at an angle greater than 0° to a plane that is perpendicular to the central axis A-A. The vanes 26*a*-26*f* define spaces between each other through which the primary gas and/or gaseous fuel mixture flows. The angle of each vane 26*a*-26*f* may be between 5 degrees and 45 degrees from the perpendicular plane. As shown in FIG. 7, the angle is 30 degrees. A ratio of an outer diameter F of the swirler 25 to a hub diameter B of the swirler 25 is between 0.4 and 0.6, which provides an optimal swirl number.

A primary gas-gaseous fuel mixture flows through an inlet side of the swirler 25 and out of an outlet side of the swirler 25 into the combustion housing 30. The primary gas and/or gas mixture exiting the swirler 25 assists with breaking up any non-atomized streaks of liquid fuel that may exit the outlet side 213. Substantially atomized fuel exiting the outlet side 213 of the orifice plate 203 vaporizes and mixes with the primary gas and/or gaseous fuel mixture, and then combusts within the housing 30. A portion of heat from the combustion also reaches upstream to preheat the primary gas and/or gas mixture products, which helps to quickly pre-vaporize the liquid fuel, allowing it to burn cleanly and resulting in low emissions.

Figure 8:
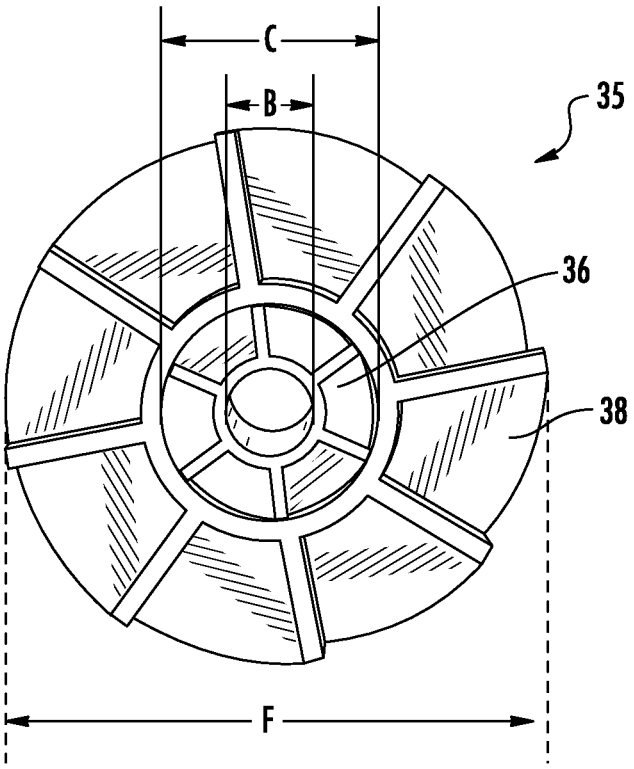
FIG. 8 illustrates a top view of an inlet swirler used for a larger capacity burner according to one implementation.

For larger scale industrial applications, such as for burners having a capacity of over 60 kWth, the swirler of the combustor assembly may include an enlarged, or double swirler, such as is shown in FIG. 8. In particular, FIG. 8 illustrates a double swirler 35 according to one implementation. The double swirler 35 includes an inner swirler 36 and an external swirler 38 that extends circumferentially around the inner swirler 36. The vane angles for the inner 36 and outer swirler 38 are 30 degrees and a ratio of an outer diameter F to a hub diameter B is between 0.4 to 0.6. Thus, the swirl number remains at its optimum value. Hence, the double vane swirler 35 shown in FIG. 8 has the same swirl angle as swirler 25 but includes a double swirl design because the outer diameter F to hub diameter B ratio for a single swirl is too large when the diameter dimensions are increased for use with larger scale combustion applications. The dimensions of the inner swirler 36 are the same as the swirler 25 for the small scale system 10, and the outer diameter B of the external swirler 38 is determined by the hub to diameter ratio. The external swirler 38 includes 8 vanes, and the internal swirler 36 includes 6 vanes, according to the implementation shown in FIG. 8.

Furthermore, dual fuels (combined liquid fuel-gaseous fuel operation) may be selected to yield fuel flexibility and/or more power. This increase in capacity is achieved because the gaseous fuel supply system is independent of the liquid fuel injector design.

When scaling the fuel injector assembly for small or large combustion applications, the scaling may be based on constant velocity scaling criterion. This criterion ensures that the residence time inside the combustion chamber is independent of the HRR. Thus, to keep the flow velocities within an acceptable or optimal range (e.g., flow velocities are within 50% of each other for various capacities), several cross sectional areas may be increased by a certain factor. For example, when increasing the capacity of a combustion system from 7 kW capacity to 60 kW capacity, several cross sectional areas may be increased by an average factor of around 9. For example, most circular diameters may be increased by a factor of around 3. For areas in which there may be a limit on maximum allowable dimension, care is taken to ensure that the flow velocity does not exceed the acceptable range, and proportionate dimension may be added to counter the effects of increases in velocity. These modifications may be implemented on the fuel injector, swirler, dump plane, combustion enclosure, and the upstream mixing tube. The length of the burner housing 30 is nearly the same for different scale combustion systems.

The combustor assembly may be used for combusting diesel, straight vegetable oil, and glycerol fuels, for example. However, other fuels may be used with this combustor assembly, such as bunker oil, minimally processed crude oil, fuels produced from algae, liquid chemical waste, conventional fuels, high viscosity fuels, alternative fuels, biofuels, and opportunity and waste fuels. In addition, this combustor assembly may use alternative gases such as steam, natural gas, and propane for the atomizing gas and/or various gaseous fuels for the primary gas flow through the swirlers.

The combustor assembly according to various implementations of the invention produces smaller droplets of fuel as compared to the AB technique and has the capability of burning fuels of very high viscosity, including straight vegetable oil (VO) and glycerol with low emissions. Since the injector tube outlet diameter and orifice exit diameter are large, the injector is not subjected to clogging by fuel contaminants or by fuel oxidation caused by heating of the fuel.

Fuel flexible, clean combustion has distinct importance for solving some of the environmental and economic concerns associated with alternative, waste, and minimally processed liquid fuels. For example, crude glycerol is generated as a byproduct of biodiesel production. Crude glycerol is considered as waste because, despite its significant energy content of 16 MJ/kg, it is very difficult to atomize and burn with traditional injectors. Thus, in its crude form, it has been of limited use. However, a combustor assembly according to various implementations, such as those described above, may allow the crude glycerol to be combusted for heat generation.

Thus, various implementations of the above described combustor assembly address several concerns that arise when applying air with the FB atomization technique to produce liquid fuel spray in combustion systems. In particular, the choke prevents back flow air entering the fuel tube from flowing too far down the fuel tube and blocking the fuel from flowing through the fuel tube, especially during the transients. In addition, the swirler prevents streaks of fuel in the combustion zone, which may be of particular concern when the fuel is highly viscous. These streaks of fuel do not burn as cleanly as droplets. Furthermore, the above described systems may be scalable for small scale to large scale industrial applications. Finally, the above described implementations of the spacer ring decrease the atomizing gasflow rate through the injector, which reduces the power consumption.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementation was chosen and described in order to best explain the principles of the invention and the practical application, and to enable others of ordinary skill in the art to understand the invention for various implementations with various modifications as are suited to the particular use contemplated.

The invention claimed is:

1. A fuel injector comprising:

an inner injector tube comprising an outlet portion defining an outlet and a choke portion, the choke portion being disposed upstream of the outlet 10 D to 20 D, wherein D is the inner diameter of the inner injector tube;

an outer injector tube spaced radially apart from at least the outlet portion of the inner injector tube, the outer injector tube having an outer injector tube outlet disposed radially adjacent the outlet of the inner injector tube; and an orifice plate defining a central opening having an inlet side and an outlet side, the central opening defining a frustoconical cross-sectional shape as taken along a central axis extending through the central opening, wherein an inner diameter of the inlet side is smaller than an inner diameter of the outlet side and the inner diameter of the inlet side is substantially the same as an inner diameter of the outlet of the inner injector tube, wherein the orifice plate directly contacts the outer injector tube, wherein the outer injector tube is co-axial with the inner injector tube, and wherein the central opening of the orifice plate is co-axial with the outlet of the inner injector tube, and the inlet side is spaced apart axially downstream from the outlet of the inner injector tube.

2. The fuel injector of claim 1, wherein the choke portion is a venturi constriction portion having an inner diameter that is smaller than the inner diameter of the outlet of the inner injector tube.

3. The fuel injector of claim 1, wherein the choke portion is a check valve.

4. The fuel injector assembly of claim 1, wherein the choke portion is integrally formed in the inner injector tube.

5. The fuel injector of claim 1, wherein the choke portion is formed separately from the inner injector tube and disposed therein.

6. The fuel injector of claim 1, wherein the choke portion has an inner diameter of between 0.2 D and 0.4 D.

7. The fuel injector of claim 1, wherein:

the fuel injector comprises a spacer ring comprising an annular wall, the annular wall defining a central axial opening and having an upper annular surface;

the upper annular surface of the spacer ring defines a plurality of axial slots, and the spacer ring is disposed adjacent the outlet of the inner injector tube, the outer injector tube outlet, and the inlet of the orifice plate such that the central opening of the orifice plate and the outlet of the inner injector tube are co-axial with the central axial opening of the spacer ring.

8. The fuel injector of claim 7, wherein the annular wall further defines a plurality of radially extending openings, the radially extending openings being defined circumferentially between the axial slots and spaced apart circumferentially around the annular wall.

9. The fuel injector of claim 7, wherein each axial slot has a height that is at least 0.2 D and a width that is twice the height of the slot, the width being measured in a direction that is tangent to a circumference of the annular wall.

10. A combustor assembly comprising:

a fuel injector comprising:

an inner injector tube comprising an outlet portion defining an outlet;

an outer injector tube spaced radially apart from at least the outlet portion of the inner injector tube, the outer injector tube having an outer injector tube outlet disposed radially adjacent the outlet of the inner injector tube; and an orifice plate defining a central opening having an inlet side and an outlet side, the central opening defining a frustoconical cross-sectional shape as taken along a central axis extending through the central opening, wherein an inner diameter of the inlet side is smaller than an inner diameter of the outlet side and the inner diameter of the inlet side is substantially the same as an inner diameter of the outlet of the inner injector tube, and wherein the central opening of the orifice plate is co-axial with the outlet of the inner injector tube, and the inlet side is spaced apart axially downstream from the outlet of the inner injector tube; and a swirler disposed radially outwardly and adjacent the outer injector tube outlet, the swirler comprising a central hub, a first plurality of vanes extending therefrom at a first angle greater than 0 degrees from a plane extending perpendicular to a central axis of the central hub, and a second plurality of vanes disposed radially outwardly of the first plurality of vanes and at a second angle greater than 0 degrees from the plane, wherein the swirler is in fluid communication with a gas supply plenum adjacent an inlet side of the swirler and a combustion housing adjacent an outlet side of the swirler, wherein the orifice plate directly contacts the outer injector tube, and wherein the outer injector tube is co-axial with the inner injector tube.

11. The combustor assembly of claim 10, wherein the fuel injector comprises a choke portion, the choke portion being disposed upstream of the outlet 10 D to 20 D wherein D is the inner diameter of the inner injector tube.

12. The combustor assembly of claim 11, wherein the choke portion is disposed 10 D upstream of the outlet.

13. The combustor assembly of claim 10, wherein the first and second plurality of swirler vanes are disposed at an angle of 30 degrees relative to the plane.

14. The combustor assembly of claim 10, wherein the fuel injector further comprises a spacer ring, the spacer ring comprising an annular wall, the annular wall defining a central axial opening and having an upper annular surface, wherein:

the upper annular surface defines a plurality of axial slots, and the spacer ring is disposed adjacent the outlet of the inner injector tube, the outer injector tube outlet, and the inlet of the orifice plate such that the central opening of the orifice plate and the outlet of the inner injector tube are co-axial with the central axial opening of the spacer ring.

15. The combustor assembly of claim 14, wherein the annular wall further defines a plurality of radially extending openings, the radially extending openings being defined circumferentially between the axial slots and spaced apart circumferentially around the annular wall.

16. The combustor assembly of claim 14, wherein each axial slot has a height that is at least 0.2 D and a width that is twice the height of the slot, the width being measured in a direction that is tangent to a circumference of the annular wall, wherein D is the inner diameter of the inner injector tube.

17. The fuel injector of claim 1, wherein the inlet side is spaced apart by not more than 0.25 D axially downstream from the outlet of the inner injector tube, wherein D is the inner diameter of the inner injector tube.

18. The combustor assembly of claim 13, wherein the inlet side is spaced apart by not more than 0.25 D axially downstream from the outlet of the inner injector tube, wherein D is the inner diameter of the inner injector tube.

* * * * *